United States Patent [19]

Singh et al.

[11] 4,197,774

[45] Apr. 15, 1980

[54] TRAVELING CUTTER ASSEMBLY

[75] Inventors: Balbir Singh, Media; Ernest M. Pinhak, Boothwyn, both of Pa.

[73] Assignee: Scott Paper Company, Philadelphia, Pa.

[21] Appl. No.: 959,359

[22] Filed: Nov. 9, 1978

[51] Int. Cl.[2] ..... B26D 1/04; B26D 7/02

[52] U.S. Cl. ..... 83/374; 83/455; 83/614

[58] Field of Search ..... 83/455, 374, 614, 175, 83/18, 20, 456, 454

[56] References Cited

U.S. PATENT DOCUMENTS

| | | | |
|---|---|---|---|
| Re. 22,565 | 11/1944 | Gillanders et al. | 83/614 |
| 1,446,404 | 2/1923 | Tackaberry | 83/614 |
| 1,745,476 | 2/1930 | Cohn | 83/175 |
| 2,503,353 | 4/1950 | Pugh | 83/175 X |
| 3,142,217 | 7/1964 | Busse | 83/455 |
| 3,222,972 | 12/1965 | Fulton | 83/564 |
| 3,277,760 | 10/1966 | Keene et al. | 83/455 |
| 3,370,497 | 2/1968 | Busse | 83/455 |
| 3,463,040 | 8/1969 | Pouilloux | 83/374 |
| 3,641,854 | 2/1972 | Keesling | 83/175 X |
| 3,791,246 | 2/1974 | Lazickas | 83/455 X |

*Primary Examiner*—Frank T. Yost

*Attorney, Agent, or Firm*—Martin L. Faigus; William J. Foley

[57] ABSTRACT

A cutting assembly of the type useable for severing a sheet into desired lengths. The assembly includes an elongate track having a slot extending through an upper wall thereof for slidably receiving and retaining a cutter slide therein. The track has upper surface segments that are roughened; preferably with laterally extending grooves spaced along a major portion of the elongate slot. A cutter slide moveable within the slot has a top member overlying the cutting element and extending beyond the element both laterally and in the direction in which the slide is moveable so as to overlie the roughened surface segments of the track. The top member has an extremely smooth stationary lower surface in the regions overlying the roughened track surfaces. This lower surface is adapted to engage a sheet positioned across the slot in overlying relationship with the roughened track surfaces and to press the sheet into engagement with the roughened surfaces for preventing relative sliding movement between the sheet and the track as the cutter slide is moved over the sheet to sever it.

4 Claims, 3 Drawing Figures

TRAVELING CUTTER ASSEMBLY

Technical Field

This invention relates to a cutting assembly, and more particularly to a cutting assembly of the type employing a cutter slide moveable within a slot of an elongate track to sever sheet material into desired lengths.

Background Art

It is often desirable to package sheet materials in roll form, and to provide a cutting mechanism so that the sheets can be severed into desired lengths; depending upon intended use. It is quite common to package such rolls in cartons that are intended to be disposed of after the rolls have been depleted. Obviously any cutting mechanism employed as part of such a carton must be sufficiently economical to manufacture to justify its disposal along with the package. Although inexpensive mechanisms, such as serrated cutting bars, are known, such mechanisms generally are not capable of accurately and easily cutting strong, flexible sheet materials of the type that tend to stretch or flex as they are being subjected to a cutting force. Moreover, in the case of serrated cutting bars, it is quite easy for a person handling the package to inadvertently cut himself.

Although other types of cutters have been disclosed for use on boxes or cartons in which roll materials are packaged, a need does exist for improved low cost cutters which can be easily fabricated, which are reliable in operation, and which are capable of cutting a wide variety of different sheet materials; particularly those that are strong, stretchable and flexible.

One prior art approach to reliably cutting flexible sheet materials is to mount the cutting blade on a moveable carrier having rotatable elements, such as wheels, that press the sheet material against a stationary plate or track for locally immobilizing the material as it is being cut. These devices have been found to work quite well; however, they are believed to be too expensive for the limited use encountered on packages of disposable products. The following patents disclose representative devices of the type employing rotatable elements as part of the cutter: U.S. Pat. Nos. 1,745,476 (Cohn); 2,503,353 (Pugh); 3,277,760 (Keene et al); 3,463,040 (Pouilloux) and 3,791,246 (Lazickas).

A different type of cutting assembly employs a clamping arrangement that is operated independently of a sliding cutter to immobilize the sheet prior to the cutting operation. In this type of device the clamping action is achieved between a stationary surface and a hinged, moveable surface. The use of relatively moveable clamping elements increases the overall cost and complexity of the cutting assembly, as compared to assemblies in which separate clamping bars, independent of the cutter slide, are not utilized. The following patents disclose representative devices of the type employing moveable clamping elements: U.S. Pat. Nos. 3,142,217 and 3,370,497 (Busse) and 3,222,972 (Fulton).

A fairly simple cutting assembly is disclosed in U.S. Pat. No. Re 22,565, issued to Gillanders et al. This device is designed for use in cutting adhesive tape, and employs a cutter knife that is adapted to move along an elongated slot in a cylindrical bore. A handle is secured to the upper end of the knife for use in moving the knife along the slot, and the handle is provided with laterally spaced-apart wings to prevent the user from accidentally contacting the blade. The wings also are employed to press the adhesive surface of the tape against a bead adjacent the slot to adhesively attach the tape to the bead. Although this cutter may be suitable for immobilizing adhesive tape by pressing its adhesive surface against the guide in which the knife is slid, there is no mechanism, either provided or suggested, for adequately immobilizing non-adhesive sheet materials during a cutting operation.

Disclosure of Invention

This invention relates to a cutting assembly of the type employing an elongate track and a cutter slide moveable within a slot of the track. The cutter slide is free of elements that move relative to each other during the cutting operation, and includes at least one cutting element having an edge for severing a sheet into desired discrete length when the sheet is positioned across the slot, and in overlying relationship with an upper track surface that is roughened. The cutter slide includes a top member overlying the cutting edge. The top member extends beyond the cutting element both laterally and in the direction of movement of the slide to overlie the roughened upper surface of the track. The top member has a smooth stationary lower surface, and this lower surface is slidable over a sheet to be cut while at the same time locally immobilizing the sheet by pressing it against the roughened upper track surface. Thus, the local immobilization takes place without providing any cutter slide elements that are moveable relative to each other during the cutting operation and without providing moveable clamping elements independent of the cutter slide. In fact, the cutter slide is capable of being formed of a series of injection molded parts that are connected together in nonmoving relationship to each other and that retain the cutting element(s) in proper cutting orientation.

The present invention takes advantage of a differential frictional coefficient to locally immobilize the sheet as it is being cut. Specifically, the upper roughened track surface, preferably formed by a series of grooves, has a coefficient of friction, $\mu_1$, with the sheet to be cut that is significantly higher than the coefficient of friction, $\mu_2$, between the exposed upper surface of said sheet and the smooth lower surface of the slider. With a normal force, F, is exerted on the material by the slider during the cutting operation, the linear force, L, immobilizing the sheet on the track, and acting in a direction opposite to the cutting direction, is calculated by the equation $L=(\mu_1-\mu_2)$ F. By employing a sharp cutting edge and a smooth stationary lower surface on the slider, a wide variety of strong and/or elastic sheet materials can be cut easily by being maintained in an immobilized condition against the roughened track surface during the cutting operation. This immobilization takes place when the linear force necessary to sever the sheet is less than the opposing linear force, L, that immobilizes the sheet on the track, and is achievable without actually piercing or penetrating the sheet to be cut with any portion of the roughened track surface.

It is an object of this invention to provide a cutting assembly which is economical to construct and reliable in operation.

It is a further object of this invention to provide a cutting assembly employing a cutter slide moveable in an elongate track, wherein the cutter slide is free of elements that move relative to each other during the cutting operation.

It is a further object of this invention to provide a cutting assembly which simply and reliably immobilizes sections of the sheet locally as they are being cut.

Other objects and advantages of this invention will become apparent by referring to the detailed description of this invention, taken in conjunction with the drawing.

Best Mode for Carrying Out the Invention

Figure 1:
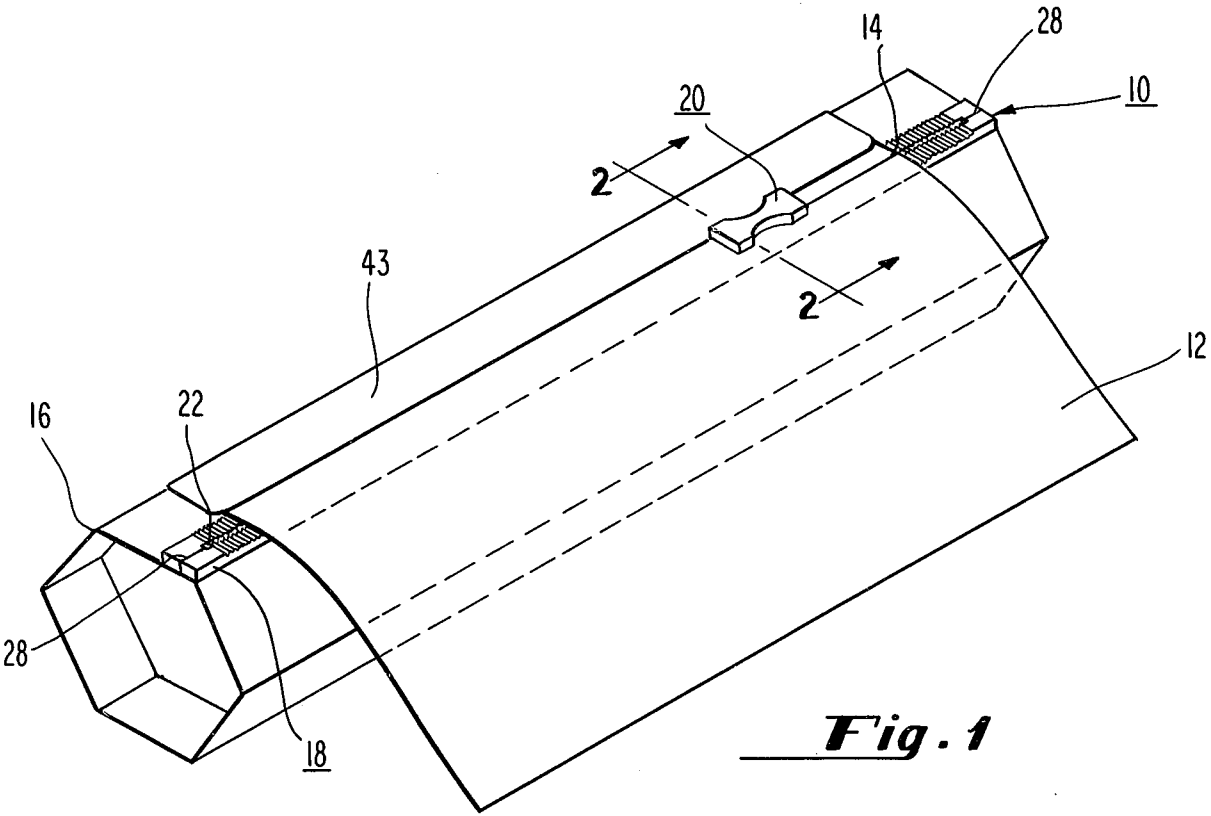
FIG. 1 is an isometric view showing the cutting assembly of this invention mounted on a box in which sheet material to be cut is packaged.

Referring to FIG. 1, the cutting assembly 10 of this invention is employed to sever a sheet or web 12 into discrete sections along a cut line 14. In the illustrated embodiment the sheet to be cut is packaged in roll form in a box 16 to which the cutting assembly 10 is attached.

Figure 2:
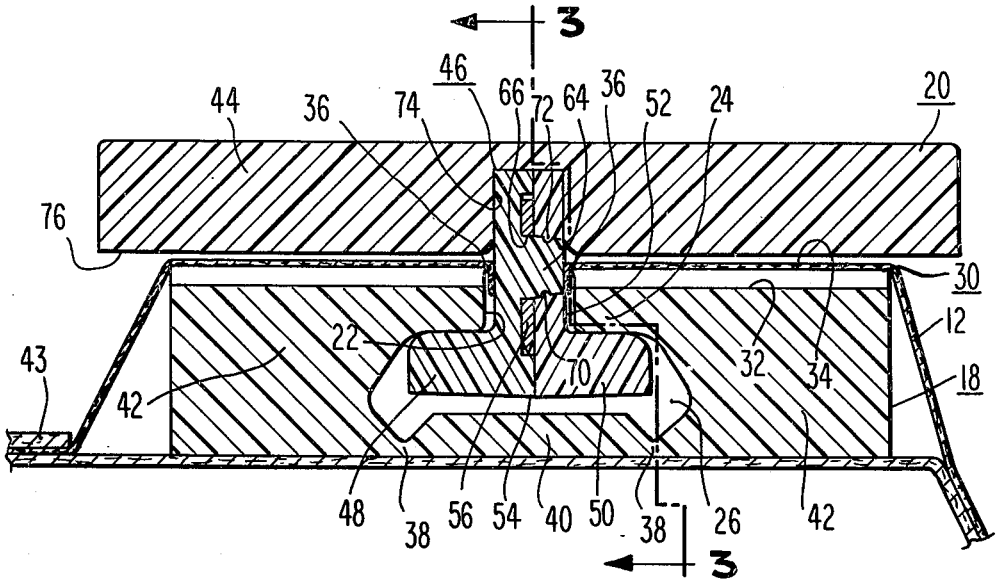
FIG. 2 is a sectional view taken along line 2—2 of FIG. 1.

Referring to FIGS. 1 and 2, the cutting assembly 10 includes a track 18 and a cutter slide 20. The cutter slide is moveable within an elongate slot 22 defined between spaced-apart inner surfaces of centrally located upper wall segments 24 of the track. The slot 22 communicates with an elongate, interior compartment 26 in which the cutter slide 20 is trapped. The elongate slot 22 and the interior compartment 26 are closed at their opposite ends 28 to prevent the slide 20 from being slid out of engagement with the track.

Figure 3:
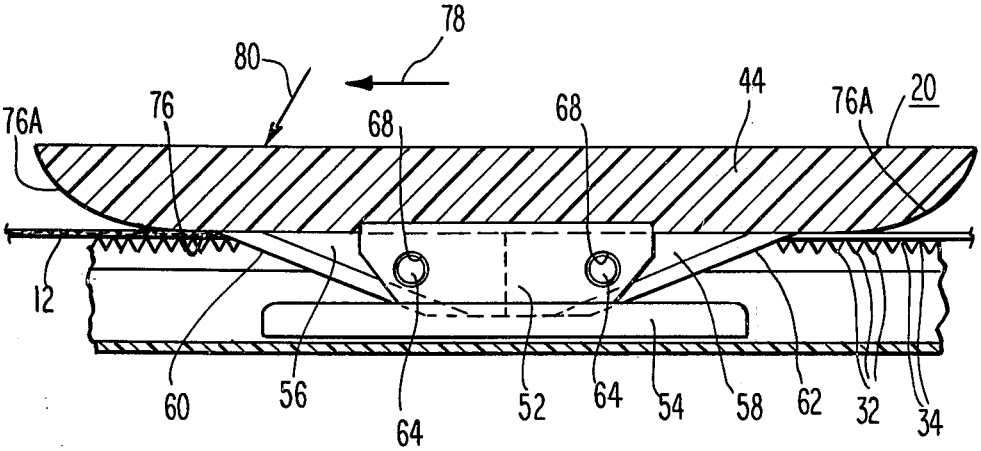
FIG. 3 is a sectional view taken along line 3—3 of FIG. 2.

As can be seen best in FIGS. 2 and 3, the track 18 includes upper surface segments 30 on opposite sides of the elongate slot 22, and each of these segments is serrated, or grooved along a major portion of its elongate dimension to provide a series of laterally extending, V-shaped grooves 32 joined together along laterally extending upper ridges 34. These upper ridges terminate at edges 36 adjacent each side of the elongate slot 22, as can be seen best in FIG. 2. The function provided by these end edges 36 will be explained in detail hereinafter.

Referring specifically to FIG. 2, the track 18 is provided with spaced-apart thin zones 38 interconnecting a centrally located bottom wall 40 with side marginal sections 42. These thin zones permit the track to be injection molded as a single unit, with the side marginal sections 42 disposed 90 degrees to the position shown in FIG. 2. In this molded orientation the compartment 26 is opened up for receiving the cutter slide 20. After the slide is positioned in the opened up compartment 26, the marginal sections 42 of the track are pivoted about the thin zones 38 to orient the track sections as shown in FIGS. 1 and 2. Thereafter, the bottom surface of the track is adhesively secured, or otherwise fastened to an outer sidewall of the box 16 adjacent a sheet dispensing opening underlying a flap 43 (FIG. 1).

The method of injection molding the track is explained in greater detail in the copending U.S. patent application of Kenard Urion and Douglas Cleminshaw, entitled CUTTING ASSEMBLY AND METHOD OF FORMING A TRACK THEREOF, and filed on even date herewith. The subject matter of this latter patent application is herein incorporated by reference. Although the method of molding the track is the joint invention of Kenard Urion and Douglas Cleminshaw, it represents the best mode contemplated by the inventor of the subject matter claimed herein for carrying out the instant invention.

Referring to FIGS. 2 and 3, the cutter slide 20 includes a top member 44 connected to a blade retainer 46. The retainer is formed of opposed male and female sections 48 and 50, respectively. When the male and female sections are connected they provide a central web section 52 extending through the elongate slot 22 of the track 18, and an enlarged flange section 54 positioned within the interior compartment 26 of said track. Note that the enlarged flange section underlies the centrally located upper wall segments 24 to prevent the cutter slide 20 from being pulled out of the track. As explained earlier, the closed track ends 28 prevent the cutter slide 20 from being slid out of its engagement with the track.

As can be seen best in FIG. 3, two blades 56 and 58 having obliquely oriented cutting surfaces 60 and 62, respectively, are secured to the blade retainer 46 for cutting the web 12 when the cutter slide is moved in either direction within the track slot 22. The blades are connected to the retainer by positioning male projections 64 of the male section 48 through respective openings 66 of the blades 56 and 58, and then into projection-receiving openings 68 in the female section 50. Both of the male projections 64 are identical; each including an annular groove 70 formed adjacent an end thereof (FIG. 2). The openings 68 provided in the female section 50 also are identical; each including an annular rib 72 for engaging the annular groove 70 of the male projection it receives to thereby lock the male and female sections of the retainer together (FIG. 2). The blade retainer 46, after it had been assembled, is secured within an elongate recess 74 formed in the underside of the slider top member 44. This securement can be achieved by employing an adhesive substance, or, most preferably, by ultrasonic bonding.

The specific construction of the blade retainer 46 and the manner in which it is connected to the top member 44 of the slider are fully disclosed in the earlier referred to Urion et al. patent application, and represents the best mode contemplated by the inventor of the subject matter herein for fabricating the cutter slide 20 of the instant invention.

Referring to FIG. 3, the cutter slide 20 is adapted to be moved in either elongate direction within the slot 22 to provide its severing function. However, it is within the scope of this invention to employ a cutter slide in which only a single cutting element is retained, in which case the cutter slide will be functional in only one direction.

Referring to FIGS. 2 and 3, the top member 44 of the cutter slide has an extremely smooth, planar lower surface 76 that extends beyond the cutting surfaces of both blades 56 and 58 in the linear directions in which the slide is moveable. In addition, the smooth surface 76 extends laterally beyond the blades to overlie the grooved upper surface segments 30 of the track 18. Curved surface sections 76A extend from opposite ends of the planar surface 76 for guiding the sheet to be cut under the top of the slide 20, as said slide is moved along the track slot 22.

As can be seen in FIGS. 2 and 3, a clearance is provided between the enlarged flange section 54 of the cutter slide and the bottom wall 40 of the track 18 when the smooth lower surface 76 engages the upper surface of the sheet to be cut. This clearance permits the smooth lower surface 76 to be forced downwardly against the upper surface of the sheet 12 to locally immobilize the sheet against the groove upper surface of the track 18 during the cutting operation. In fact, as the cutter slide 20 is being moved along the track (e.g., in the direction of arrow 78) it will be subjected to a force having both horizontal and downward components. This creates a resultant force at an angle, indicated schematically by the arrow 80, that will tend to cant, or tilt the cutter slide 20 against the sheet 12 in a region ahead of the cutting blade 56 to thereby locally immobilize a section of the sheet just prior to the cutting operation. This immobilizing action will be maintained, although possibly with a somewhat lesser force, as the cutting operation takes place. Moreover, due to the oblique orientation of the cutting edges 60 and 62 the sheet 12 will be forced downwardly into the track slot 22 during the cutting operation to locally immobilize the sheet against the edges 36 of the groove ridges 34 that are close to, and on opposite sides of the cut line 14 (FIG. 1). This improves the cutting operation by minimizing the tendency for the sheet to be buckled, or plowed, rather than be cut when exposed to the horizontal force component imposed on the sheet by the cutting blades 56 or 58.

The present invention is well suited for severing a wide variety of sheet materials. However, the greatest benefits can be achieved by employing this cutting assembly to sever sheets that are strong, flexible and elastic. It is these latter types of sheets which generally tend to be plowed, rather than be cut by the cutting blade, unless they are adequately immobilized as the cutting operation is performed. The present invention takes advantage of a differential coefficient of friction, as was explained earlier, to locally immobilize the sheet as it is being cut. This is accomplished in an economical and reliable manner by, in part, employing a cutter slide that does not rely upon relatively moveable parts, such as rolls and belts, to aid in the cutting operation.

It was quite surprising to discover that the present invention was capable of immobilizing strong and flexible sheet materials while performing the cutting operation in an extremely reliable manner. In fact, the present invention has been employed with success in severing a laminate including a air-laid, adhesively bonded nonwoven sheet having a basis weight in excess of 2 oz./yd.$^2$, adhesively secured to a thin (i.e., approximately 1 mil), flexible and stretchable polyethylene sheet. The air-laid web was formed in accordance with the teachings of Norton et al. U.S. Pat. No. 3,862,472, the subject matter of which is herein incorporated by reference.

In severing the above-described laminate the plastic film was placed in engagement with the grooved upper surface segments 30 of the track, and the lower smooth surface of the top member of the cutter slide 20 was moved over an adhesively bonded surface of the air-laid sheet. The cutter slide locally immobilized the sheet as the blade performed its cutting operation in an efficient and reliable manner.

Although the invention has been described with a certain degree of particularity, it is understood that the present disclosure has been made only by way of example, and that numerous changes in the details of construction and in the combination and arrangement of parts may be restored to without departing from the scope of the invention.

What is claimed as the invention is:

1. A cutting assembly of the type useable for severing a sheet into desired lengths, said assembly including:

an elongate track having upper wall sections terminating in spaced-apart inner surfaces defining an elongate slot, said upper wall sections having roughened top surfaces;

a cutter slide moveable in the slot and including a cutting element having a cutting edge adapted to engage and severe the sheet when said sheet is positioned across the slot and in overlying relationship with the roughened top track surfaces, said cutter slide including a top member overlying the cutting edge and extending laterally beyond the cutting element in overlying relationship with the roughened track surfaces, said top member having an extremely smooth stationary lower surface in regions overlying the roughened track surfaces, said cutter slide being moveable in the track with the smooth lower surface of the top member in sliding engagement with the sheet and pressing said sheet into engagement with the roughened top track surfaces to prevent relative sliding movement between the sheet and the track as the cutter slide is being moved to cut said sheet.

2. The cutting assembly of claim 1 wherein the roughened top surfaces of the track are provided by a series of laterally directed grooves spaced along the elongate extent of each upper wall section of the track and extending into and through the inner surfaces defining the elongate slot.

3. The cutting assembly of claim 2 wherein upper edges of the grooved upper surfaces lie in a substantially horizontal plane and the smooth lower surface of the cutter slide top member includes substantially horizontal regions for engaging and pressing the sheet against the grooved upper surfaces.

4. The cutting assembly of claim 3 wherein the cutting edge of the cutting element is inclined at an acute angle with the elongate slot to force the substrate against corners of the upper edges of the grooved surfaces adjacent the slot to aid in immobilizing the sheet as the cutting edge performs its cutting function.

* * * * *